US009671802B2

(12) United States Patent
Sugiura et al.

(10) Patent No.: US 9,671,802 B2
(45) Date of Patent: Jun. 6, 2017

(54) VOLTAGE REGULATOR HAVING OVERSHOOT SUPPRESSION

(71) Applicant: Seiko Instruments Inc., Chiba-shi, Chiba (JP)

(72) Inventors: Masakazu Sugiura, Chiba (JP); Tsutomu Tomioka, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 0 days.

(21) Appl. No.: 14/968,129

(22) Filed: Dec. 14, 2015

(65) Prior Publication Data

US 2016/0181924 A1 Jun. 23, 2016

(30) Foreign Application Priority Data

Dec. 19, 2014 (JP) ..... 2014-256851

(51) Int. Cl.
*G05F 1/56* (2006.01)
*G05F 1/565* (2006.01)

(52) U.S. Cl.
CPC ..... *G05F 1/565* (2013.01)

(58) Field of Classification Search
CPC ..... G05F 1/56; G05F 1/562; G05F 1/571
See application file for complete search history.

(56) References Cited

U.S. PATENT DOCUMENTS 8,072,198 B2 * 12/2011 Imura ..... G05F 1/56 323/226
8,379,702 B2 * 2/2013 Lutz ..... 375/222
2008/0265852 A1 * 10/2008 Imura ..... G05F 1/575 323/277
2011/0228823 A1 * 9/2011 Lutz ..... H04B 3/141 375/219
2012/0206119 A1 * 8/2012 Sugiura ..... G05F 1/56 323/282
2012/0242312 A1 * 9/2012 Heng ..... G05F 1/575 323/282
2013/0271103 A1 * 10/2013 Gerber ..... G06F 1/263 323/299
2014/0070778 A1 * 3/2014 Nihei ..... G05F 1/575 323/271

(Continued)

FOREIGN PATENT DOCUMENTS

JP 2004-252891 A 9/2004

*Primary Examiner* — Matthew Nguyen
*Assistant Examiner* — Yusef Ahmed
(74) *Attorney, Agent, or Firm* — Brinks Gilson & Lione

(57) ABSTRACT

Provided is a voltage regulator capable of applying an optimal overshoot suppression unit depending on states. The voltage regulator includes: an amplifier for controlling an output transistor based on a voltage obtained by amplifying a difference between a divided voltage and a reference voltage; a first overshoot suppression unit for controlling a gate voltage of the output transistor, to thereby suppress overshoot of the output voltage; a second overshoot suppression unit for controlling an operating current of the amplifier, to thereby suppress the overshoot of the output voltage; and a control circuit. The control circuit is configured to turn on the first overshoot suppression unit immediately after the voltage regulator is powered on, and turn off the first overshoot suppression unit under a state in which the output voltage is stable.

1 Claim, 4 Drawing Sheets

(56) References Cited

U.S. PATENT DOCUMENTS

| | | | | |
|---|---|---|---|---|
| 2014/0091776 | A1* | 4/2014 | Matsuda | H02H 9/04 323/282 |
| 2014/0269136 | A1* | 9/2014 | Kamiya | G11O 5/14 365/226 |
| 2014/0368178 | A1* | 12/2014 | Uehara | G05F 1/56 323/282 |
| 2015/0177752 | A1* | 6/2015 | Nakashimo | G05F 1/10 323/265 |
| 2016/0226378 | A1* | 8/2016 | Suzuki | G05F 1/565 |

* cited by examiner

VOLTAGE REGULATOR HAVING OVERSHOOT SUPPRESSION

RELATED APPLICATIONS

This application claims priority under 35 U.S.C. §119 to Japanese Patent Application No. 2014-256851 filed on Dec. 19, 2014, the entire content of which is hereby incorporated by reference.

BACKGROUND OF THE INVENTION

Field of the Invention

The present invention relates to a voltage regulator capable of improving overshoot characteristics of the voltage regulator.

Description of the Related Art

As illustrated in FIG. 4, a related-art voltage regulator includes: a voltage regulator control circuit including an amplifier 402 supplied with power from a current source 403, the amplifier 402 being configured to amplify a voltage difference between a reference voltage VREF of a voltage source 401, and a voltage of a node between resistors 405 and 406 forming a voltage divider circuit for dividing a voltage of an output terminal 407 of the voltage regulator (hereinafter referred to as "VOUT"); an output transistor 404 configured to be controlled based on an output voltage of the amplifier 402; and overshoot suppression means 400 including a resistor 411, a capacitor 412, and a transistor 413. The related-art voltage regulator is operated with a positive power supply voltage (hereinafter referred to as "VDD").

When the output voltage of the amplifier 402 is represented by VERR, and the voltage of the node between the resistors 405 and 406 is represented by VFB, VERR is low if VREF>VFB is established, whereas VERR is high if VREF<VFB is established.

When VERR is low, an ON-resistance of the output transistor 404 is low and VOUT is high. In contrast, when VERR is high, the ON-resistance of the output transistor 404 is high and VOUT is low. In both the cases, VREF=VFB is established, and VOUT is kept constant.

Immediately after the voltage regulator is powered on, VOUT is still low and VREF>VFB is established. At this time, the output transistor 404 is controlled to have a low ON-resistance, and hence overshoot is liable to occur in VOUT. In order to cope with this, the transistor 413 is controlled to be on for a certain period that is determined based on a time constant of the resistor 411 and the capacitor 412 so that VERR becomes a voltage close to VDD. As a result, the output transistor 404 is controlled to be off, and consequently overshoot of VOUT may be suppressed (see, for example, Japanese Patent Application Laid-open No. 2004-252891).

However, in the related-art voltage regulator illustrated in FIG. 4, the transistor 413 is controlled to be off when overshoot of VOUT is being suppressed. Thus, if a load is connected to the output terminal 407 of the voltage regulator, undershoot may occur in VOUT.

That is, optimal overshoot suppression means differs depending on states of the power supply voltage and a load, but the related-art voltage regulator cannot deal with such changes in states, which is a problem.

SUMMARY OF THE INVENTION

The present invention has been made in order to solve the problem described above, and provides a voltage regulator capable of applying optimal overshoot suppression means based on states.

In order to solve the related-art problem, a voltage regulator according to one embodiment of the present invention has the following configuration.

The voltage regulator includes: an amplifier for controlling an output transistor based on a voltage obtained by amplifying a difference between a divided voltage and a reference voltage; first overshoot suppression means for controlling a gate voltage of the output transistor, to thereby suppress overshoot of the output voltage; second overshoot suppression means for controlling an operating current of the amplifier, to thereby suppress the overshoot of the output voltage; and a control circuit. The control circuit is configured to turn on the first overshoot suppression means immediately after the voltage regulator is powered on, and turn off the first overshoot suppression means under a state in which the output voltage is stable.

According to the voltage regulator of the one embodiment of the present invention, a voltage regulator capable of applying optimal overshoot suppression means based on states may be provided.

DETAILED DESCRIPTION OF THE PREFERRED EMBODIMENTS

Figure 1:
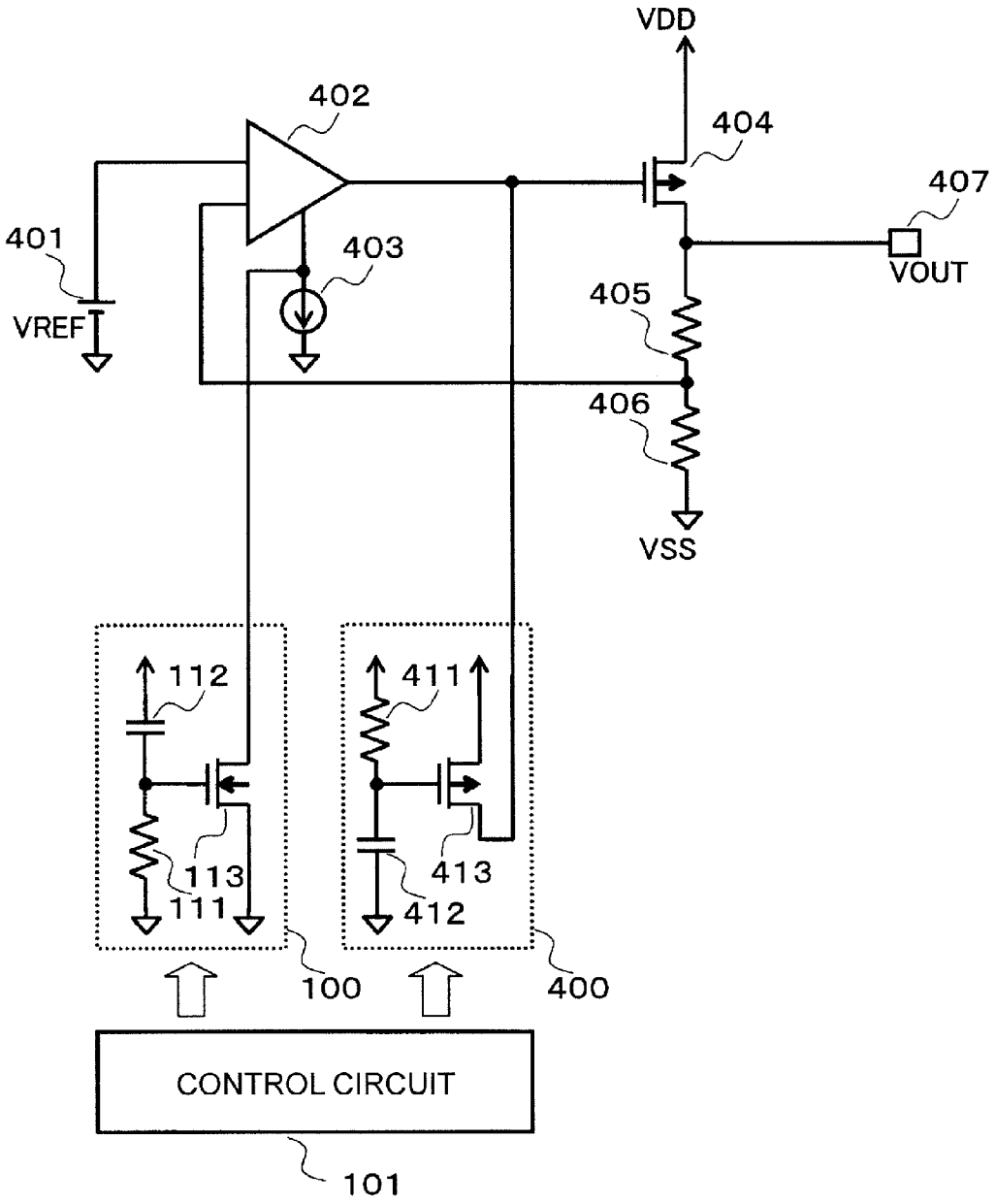
FIG. 1 is an explanatory diagram for illustrating a voltage regulator according to a first embodiment of the present invention.

FIG. 1 is an explanatory diagram for illustrating a voltage regulator according to a first embodiment of the present invention. The voltage regulator of the first embodiment includes a voltage source 401, an amplifier 402, a current source 403, an output transistor 404, resistors 405 and 406 forming a voltage divider circuit, an output terminal 407, overshoot suppression means 100, overshoot suppression means 400, and a control circuit 101.

The overshoot suppression means 100 includes a resistor 111, a capacitor 112, and a transistor 113. The overshoot suppression means 400 includes a resistor 411, a capacitor 412, and a transistor 413.

The resistor 111 and the capacitor 112 are connected in series between a positive power supply voltage (hereinafter referred to as "VDD") and a negative power supply voltage (hereinafter referred to as "VSS"). The transistor 113 has a drain and a source respectively connected to an input terminal of the current source 403 and VSS, and a gate connected to a node between the resistor 111 and the capacitor 112.

The resistor 411 and the capacitor 412 are connected in series between VDD and VSS. The transistor 413 has a drain and a source respectively connected to VDD and an output terminal of the amplifier 402, and a gate connected to a node between the resistor 411 and the capacitor 412.

The voltage source 401 outputs a reference voltage (hereinafter referred to as "VREF"). The voltage divider circuit divides a voltage of the output terminal 407 (hereinafter referred to as "VOUT") and outputs the resultant voltage (hereinafter referred to as "VFB"). The amplifier 402 amplifies a difference between VREF and VFB and outputs the resultant voltage (hereinafter referred to as "VERR"). The current source 403 causes an operating current of the amplifier 402 to flow. The overshoot suppression means 100 detects a fluctuation in power supply voltage and controls the operating current of the amplifier 402. The overshoot suppression means 400 detects a fluctuation in power supply voltage and controls a gate of the output transistor 404. The control circuit 101 has a first output terminal connected to the overshoot suppression means 100, and a second output terminal connected to the overshoot suppression means 400. The control circuit 101 controls the overshoot suppression means 100 and 400 to be on and off.

Next, the operation of the voltage regulator of the first embodiment is described. The basic operation of this embodiment is the same as that of the related-art voltage regulator.

Immediately after the voltage regulator is powered on, VOUT is still low and VREF>VFB is established. At this time, the output transistor 404 is controlled to have a low ON-resistance, and hence overshoot is liable to occur in VOUT. In order to cope with this, the transistor 413 is controlled to be on for a certain period that is determined based on a time constant of the resistor 411 and the capacitor 412 so that VERR becomes a voltage close to VDD. The output transistor 404 is controlled to be off, and consequently overshoot of VOUT is suppressed. In short, the overshoot suppression means 400 controls the output transistor 404 to be off, to thereby suppress overshoot of VOUT.

Immediately after the voltage regulator is powered on, that is, when the ON-resistance of the output transistor 404 is low, overshoot is very liable to occur in VOUT. In this state, overshoot suppression means for quickly controlling the transistor 413 to be off is required. Thus, performing the operation of controlling the output transistor 404 to be off is appropriate overshoot suppression means based on states.

After that, in a normal state in which VREF=VFB is established and VOUT is kept at a predetermined voltage, overshoot suppression means taking undershoot into consideration is required. In view of this, the transistor 113 is controlled to be on for a certain period that is determined based on a time constant of the resistor 111 and the capacitor 112 so that the operating current of the amplifier 402 is increased. As a result, the amplifier 402 can quickly control the output transistor 404, and hence overshoot of VOUT is suppressed. In short, the overshoot suppression means 400 controls the operating current of the amplifier 402 to be increased, to thereby suppress overshoot of VOUT.

In the normal state in which VOUT is kept at a predetermined voltage, the overshoot suppression operation of controlling the transistor 413 to be off may cause undershoot in VOUT. In this state, overshoot suppression means taking undershoot into consideration is required. Thus, performing the overshoot suppression operation of controlling the operating current of the amplifier 402 to be increased is appropriate overshoot suppression means based on states.

In this case, the control circuit 101 selectively allows a plurality of overshoot suppression means to function depending on states. In the case of the voltage regulator of the first embodiment, the overshoot suppression means 400 functions immediately after the voltage regulator is powered on, and the overshoot suppression means 100 functions in the normal state. As a method of controlling the overshoot suppression means 100 and 400, for example, switches respectively connected to the transistor 413 and the transistor 113 in series may be controlled to be on and off. Further, for example, switches respectively connected to the resistor 411 and the resistor 111 in parallel may be controlled to be on and off.

Note that, the control circuit 101 performs the control based on the magnitude of the ON-resistance of the output transistor 404. As a result, the control circuit 101 can determine whether or not VREF>VFB is established and the ON-resistance of the output transistor 404 is extremely low, and can thus selectively allow appropriate overshoot suppression means to function based on states. For example, there is means including a transistor connected to the output transistor in parallel, for determining the magnitude of a current caused to flow by the transistor.

Further, the control circuit 101 performs the control based on the power supply voltage. For example, there is means including a voltage detector for monitoring a voltage of the power supply, for determining that the voltage regulator has been powered on based on an output of the voltage detector.

Further, the control circuit 101 operates based on the voltage VOUT. For example, there is means including a voltage detector for monitoring VOUT, for determining that the voltage regulator has been powered on based on an output of the voltage detector.

Further, the configuration of the overshoot suppression means 400 is not necessarily limited to the circuit described above as long as the overshoot suppression means 400 can perform the operation of controlling the output transistor 404 to be off. For this reason, it is only necessary to control the overshoot suppression means to be on and off depending on the configuration, and hence how the control circuit 101 allows the overshoot suppression means to function is not necessarily limited.

As described above, according to the voltage regulator of the first embodiment, a voltage regulator capable of applying optimal overshoot suppression means based on states can be provided.

Figure 2:
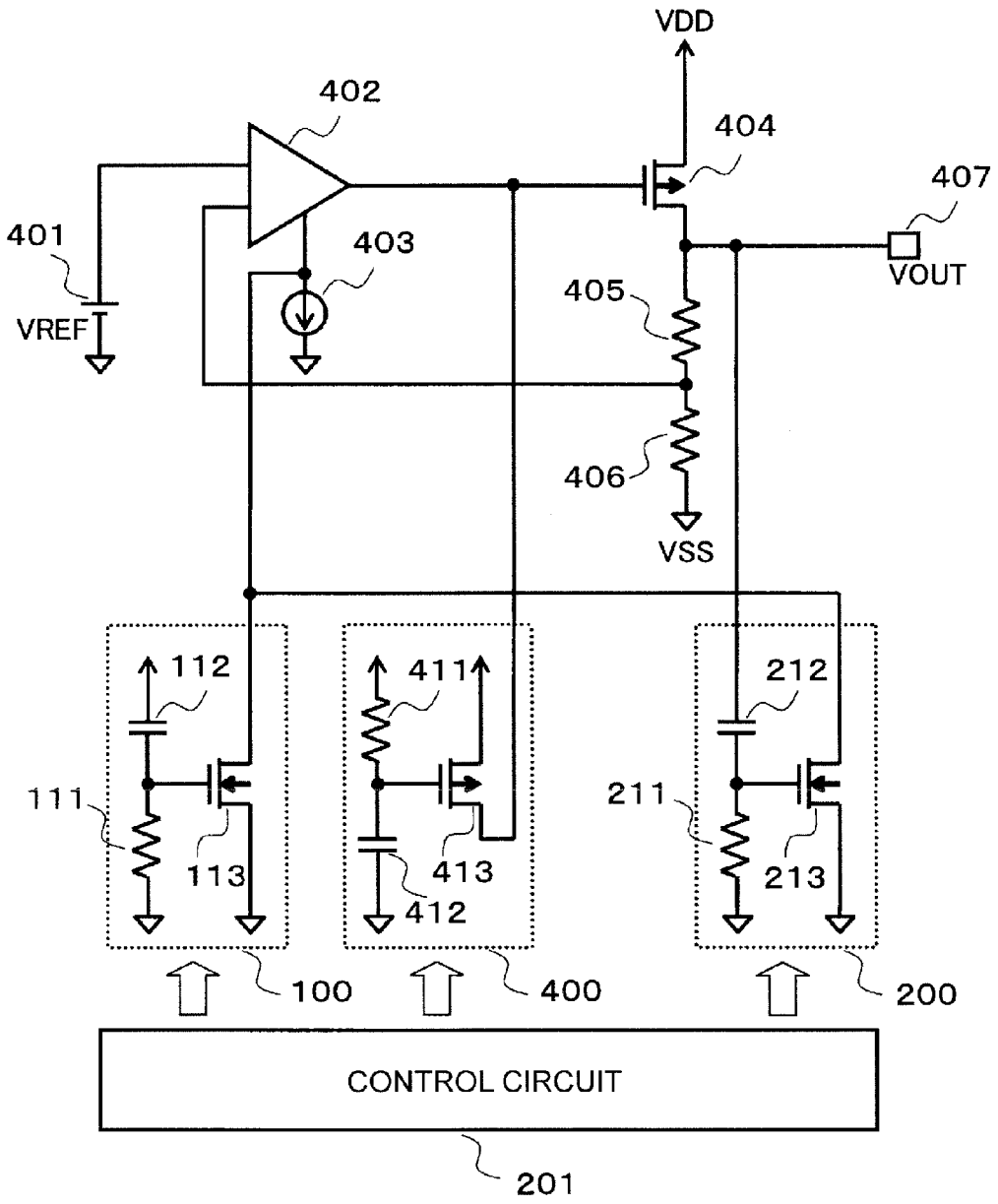
FIG. 2 is an explanatory diagram for illustrating another example of the voltage regulator of the first embodiment.

FIG. 2 is an explanatory diagram for illustrating another example of the voltage regulator according to the first embodiment. The voltage regulator of FIG. 2 includes overshoot suppression means 200 and a control circuit 201. The overshoot suppression means 200 includes a resistor 211, a capacitor 212, and a transistor 213.

The resistor 211 and the capacitor 212 are connected in series between VOUT and VSS. The transistor 213 has a drain and a source respectively connected to an input terminal of the current source 403 and VSS, and a gate connected to a node between the resistor 211 and the capacitor 212.

The overshoot suppression means 200 detects a fluctuation in VOUT and controls the operating current of the amplifier 402. The control circuit 201 has a first output terminal connected to the overshoot suppression means 100, a second output terminal connected to the overshoot suppression means 400, and a third output terminal connected to the overshoot suppression means 200. The control circuit 201 controls the overshoot suppression means 100, 200, and 400 to be on and off.

Next, the operation of the voltage regulator of FIG. 2 is described. Other controls and operations than those of the overshoot suppression means 200 are the same as in the voltage regulator of the first embodiment, and descriptions thereof are thus omitted.

When VOUT fluctuates, the overshoot suppression means 200 controls the transistor 213 to be on for a certain period that is determined based on a time constant of the resistor 211 and the capacitor 212 so that the operating current of the amplifier 402 is increased. As a result, the amplifier 402 can quickly control the output transistor 404, and hence overshoot of VOUT is suppressed. In short, the overshoot suppression means 200 controls the operating current of the amplifier 402 to be increased, to thereby suppress overshoot of VOUT.

Controlling, in the normal state in which VOUT is kept at a predetermined voltage irrespective of the power-on and a power supply fluctuation, the operating current of the amplifier 402 to be increased when VOUT fluctuates is appropriate overshoot suppression means based on states.

Figure 3:
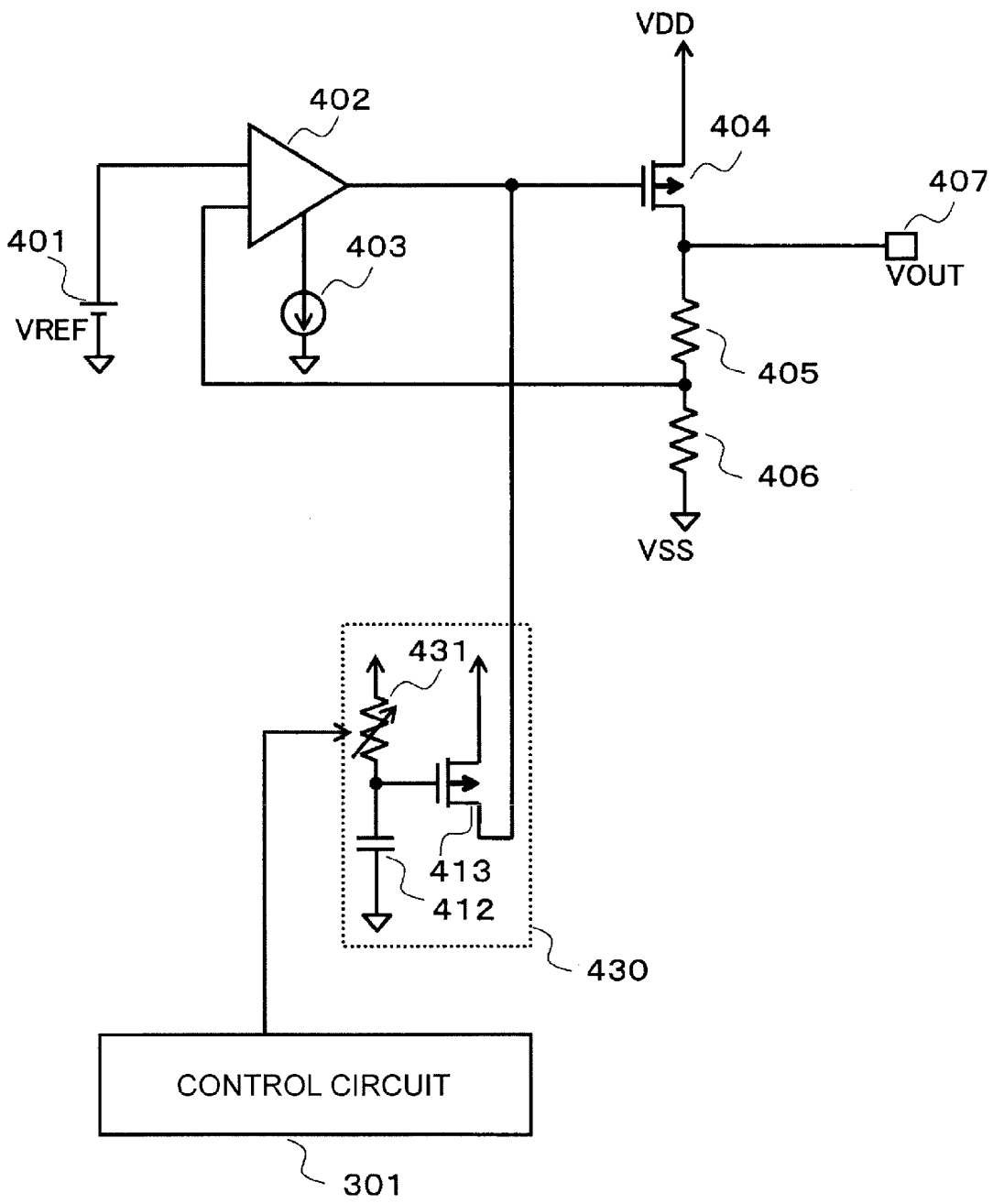
FIG. 3 is an explanatory diagram for illustrating a voltage regulator according to a second embodiment of the present invention.
Figure 4:
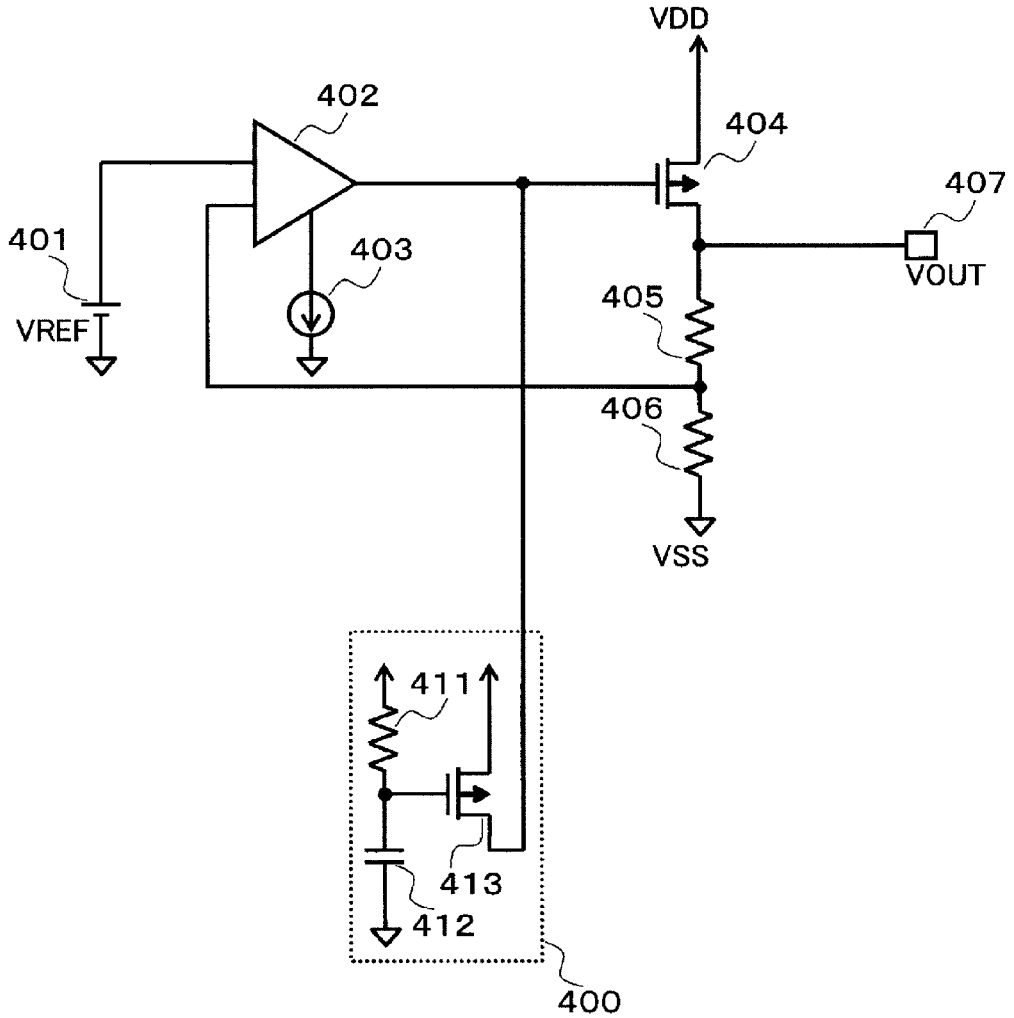
FIG. 4 PRIOR ART
FIG. 4 is an explanatory diagram for illustrating a related-art voltage regulator.

FIG. 3 is an explanatory diagram for illustrating a voltage regulator according to a second embodiment of the present invention. The voltage regulator of the second embodiment includes overshoot suppression means 430 and a control circuit 301.

The overshoot suppression means 430 includes a variable resistor 431, a capacitor 412, and a transistor 413.

The variable resistor 431 and the capacitor 412 are connected in series between VDD and VSS. The transistor 413 has a drain and a source respectively connected to VDD and an output terminal of the amplifier 402, and a gate connected to a node between the variable resistor 431 and the capacitor 412. The control circuit 301 has an output terminal connected to the overshoot suppression means 430, and controls the variable resistor 431.

Next, the operation of the voltage regulator of the second embodiment is described. The basic operation of this embodiment is the same as that of the voltage regulator of the first embodiment.

Immediately after the voltage regulator is powered on, VOUT is still low and VREF>VFB is established. At this time, the output transistor 404 is controlled to have a low ON-resistance, and hence overshoot is liable to occur in VOUT. In order to cope with this, the control circuit 301 trims a resistance value of the variable resistor 431 so that the variable resistor 431 has a larger resistance value. Further, the transistor 413 is controlled to be on for a certain long period that is determined based on a time constant of the variable resistor 431 and the capacitor 412 so that VERR becomes a voltage close to VDD. As a result, the output transistor 404 is controlled to be off, and hence overshoot of VOUT is suppressed. In short, the overshoot suppression means 430 controls the output transistor 404 to be off, to thereby suppress overshoot of VOUT.

In the normal state in which VOUT is kept at a predetermined voltage, when VDD fluctuates, overshoot suppression means taking undershoot into consideration is required. In view of this, the control circuit 301 trims a resistance value of the variable resistor 431 so that the variable resistor 431 has a smaller resistance value. Then, the transistor 413 is controlled to be on for a certain period that is determined based on a time constant of the variable resistor 431 and the capacitor 412 and is shorter than that in the case of the power-on so that VERR becomes a voltage close to VDD. With such control, a period during which the transistor 413 is controlled to be off is shortened, and hence overshoot suppression means taking undershoot of VOUT into consideration is realized.

Note that, even when the voltage regulator of the second embodiment includes the overshoot suppression means 200, the same effect as the voltage regulator of FIG. 2 is provided. In this case, the second output terminal of the control circuit 301 is connected to the overshoot suppression means 200, and the control circuit 301 controls the overshoot suppression means 200 to be on and off.

As described above, according to the voltage regulator of the second embodiment, a voltage regulator capable of applying optimal overshoot suppression means based on states can be provided.

Note that, in the above description, the overshoot suppression means 100 and the overshoot suppression means 400 function based on a fluctuation in power supply voltage, but the overshoot suppression means 100 and 400 may be configured to function based on a fluctuation in output voltage.

Further, a configuration in which one or both of the overshoot suppression means 100 and the overshoot suppression means 200 are not controlled to be off does not depart from the gist of the invention of the subject application.

What is claimed is:

1. A voltage regulator, comprising:

an amplifier configured to control an output transistor based on a voltage obtained by amplifying a difference between a divided voltage obtained by dividing an output voltage and a reference voltage;

first overshoot suppression circuit configured to control a gate voltage of the output transistor, to thereby suppress overshoot of the output voltage;

second overshoot suppression circuit configured to control an operating current of the amplifier, to thereby suppress the overshoot of the output voltage, wherein the second overshoot suppression circuit comprises:

a first suppression circuit configured to function based on power-on and a fluctuation of a power supply voltage; and a second suppression circuit configured to function based on a fluctuation in the output voltage; and a control circuit for turning on the first overshoot suppression circuit immediately after the voltage regulator is powered on, and turning off the first overshoot suppression circuit under a state in which the output voltage is stable.

* * * * *